US011107617B2

(12) United States Patent
Yamada et al.

(10) Patent No.: US 11,107,617 B2
(45) Date of Patent: Aug. 31, 2021

(54) TRANSFORMER

(71) Applicant: HITACHI, LTD., Tokyo (JP)

(72) Inventors: Yu Yamada, Tokyo (JP); Takashi Ishigami, Tokyo (JP); Akira Nishimizu, Tokyo (JP); Kouji Sasaki, Tokyo (JP)

(73) Assignee: HITACHI, LTD., Tokyo (JP)

( * ) Notice: Subject to any disclaimer, the term of this patent is extended or adjusted under 35 U.S.C. 154(b) by 559 days.

(21) Appl. No.: 16/094,146

(22) PCT Filed: Apr. 19, 2016

(86) PCT No.: PCT/JP2016/062314
§ 371 (c)(1),
(2) Date: Oct. 16, 2018

(87) PCT Pub. No.: WO2017/183095
PCT Pub. Date: Oct. 26, 2017

(65) Prior Publication Data

US 2019/0096562 A1 Mar. 28, 2019

(51) Int. Cl.
*H01F 27/06* (2006.01)
*H01F 27/245* (2006.01)
*H01F 27/26* (2006.01)

(52) U.S. Cl.
CPC ..... *H01F 27/06* (2013.01); *H01F 27/245* (2013.01); *H01F 27/26* (2013.01)

(58) Field of Classification Search
CPC ..... H01F 27/06; H01F 27/245; H01F 27/26
See application file for complete search history.

(56) References Cited

U.S. PATENT DOCUMENTS 2,466,448 A * 4/1949 Lentz ..... H01F 27/263 336/197
3,234,492 A * 2/1966 Cure ..... H01F 27/303 336/65

(Continued)

FOREIGN PATENT DOCUMENTS

JP 2010-062279 A 3/2010
JP 2013-008808 A 1/2013

OTHER PUBLICATIONS

International Search Report dated Jul. 12, 2016, issued in counterpart International Application No. PCT/JP2016/062314, with English Translation.

*Primary Examiner* — Elvin G Enad
*Assistant Examiner* — Malcolm Barnes
(74) *Attorney, Agent, or Firm* — Miles & Stockbridge, P.C.

(57) ABSTRACT

The present invention is to improve a performance of a transformer having wound iron cores. The transformer having the wound iron cores which have multi-layer band-shape magnetic material, and a coil wound to pass through an inner circumference of the wound iron core, includes a wound iron core holding member that is a member longer than a width of the wound iron core for supporting an upper inner portion of the wound iron core, a coil holding member for supporting a lower outer portion of the coil, a first support structure including an upper beam arranged on an outer circumference of the wound iron core to support the wound iron core holding member, and a lower beam arranged on an outer circumference of the coil to support the coil holding member, and a second support structure including a pair of outer plates arranged on an inner portion of the upper frame and connected to a connection member that is longer than a width obtained by adding a diameter of the wound iron core and a diameter of the coil, and a wound iron core protection (Continued)

structure that is longer than a width of the wound iron core, for covering a portion where the outer circumference of the coil and an inner portion of the wound iron core face each other, and being connected to the outer plates.

10 Claims, 12 Drawing Sheets

(56) References Cited

U.S. PATENT DOCUMENTS

| | | | | |
|---|---|---|---|---|
| 4,837,543 | A * | 6/1989 | Humen | H01F 27/02 336/196 |
| 6,005,468 | A * | 12/1999 | Shirahata | H01F 27/306 336/210 |
| 2002/0057180 | A1* | 5/2002 | Shirahata | H01F 30/12 336/213 |
| 2011/0234360 | A1* | 9/2011 | Nakanoue | H01F 27/245 336/221 |
| 2011/0273255 | A1* | 11/2011 | Thompson | H01F 27/02 336/94 |
| 2012/0206231 | A1* | 8/2012 | Kubota | H01F 3/04 336/198 |
| 2013/0106547 | A1* | 5/2013 | Takahashi | H01F 27/306 336/60 |
| 2015/0028977 | A1 | 1/2015 | Nakanoue et al. | |
| 2015/0187489 | A1 | 7/2015 | Kubota et al. | |
| 2019/0006093 | A1* | 1/2019 | Kim | H01F 27/33 |

* cited by examiner

[FIG. 1]
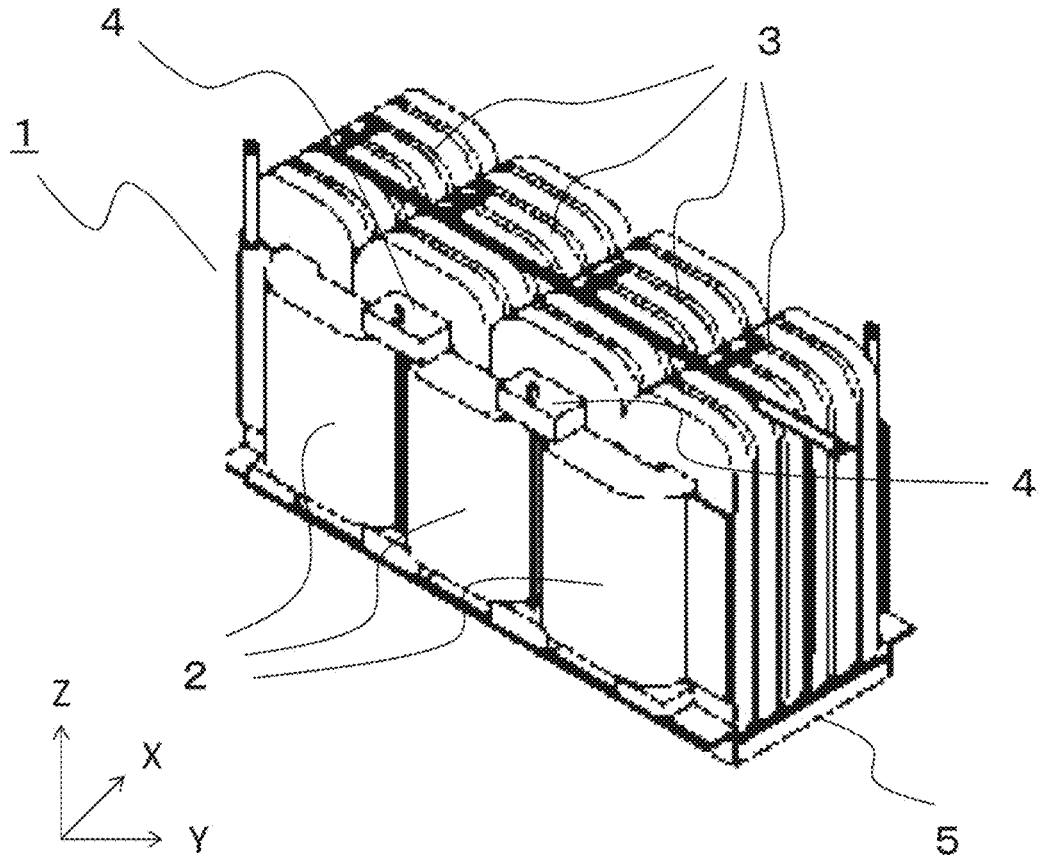
[FIG. 2A]
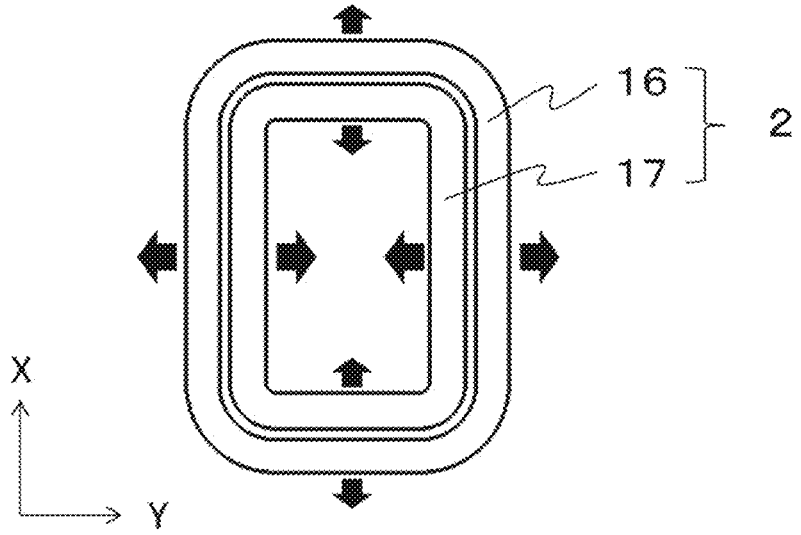

[FIG. 2B]
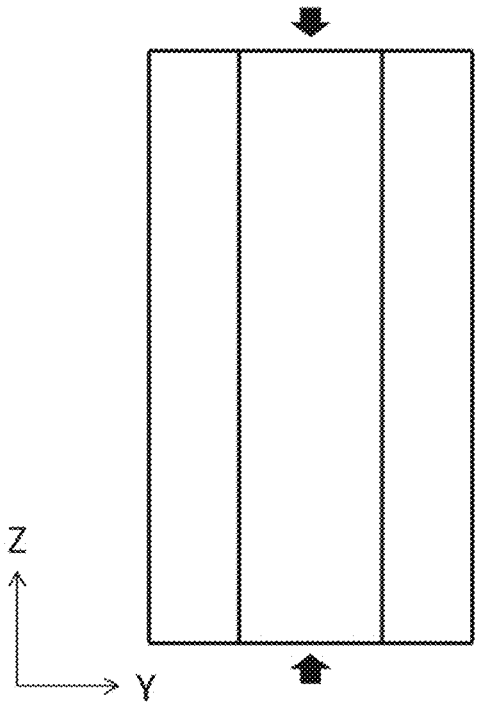
[FIG. 3A]
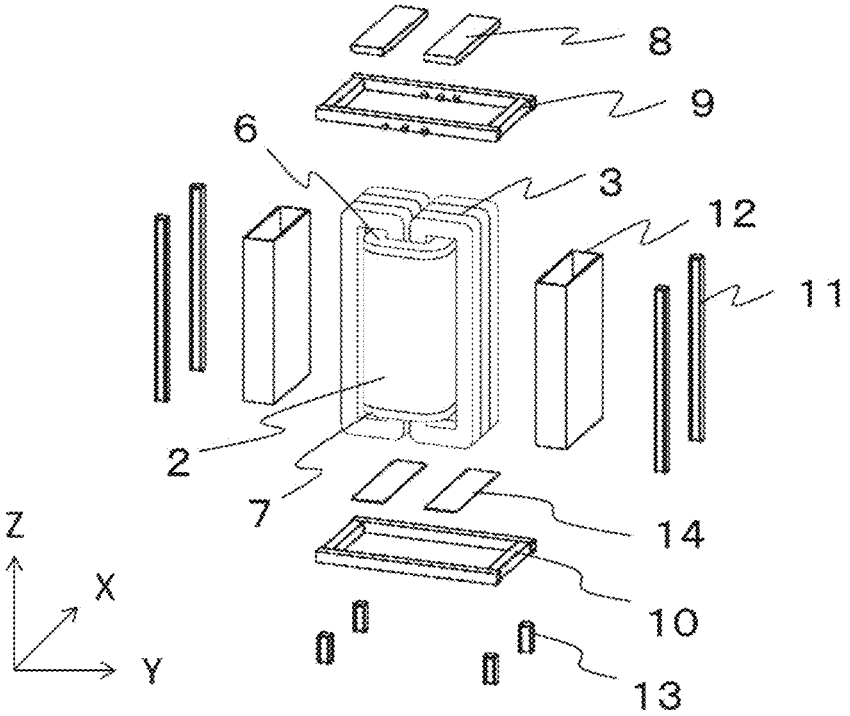

[FIG. 3B]
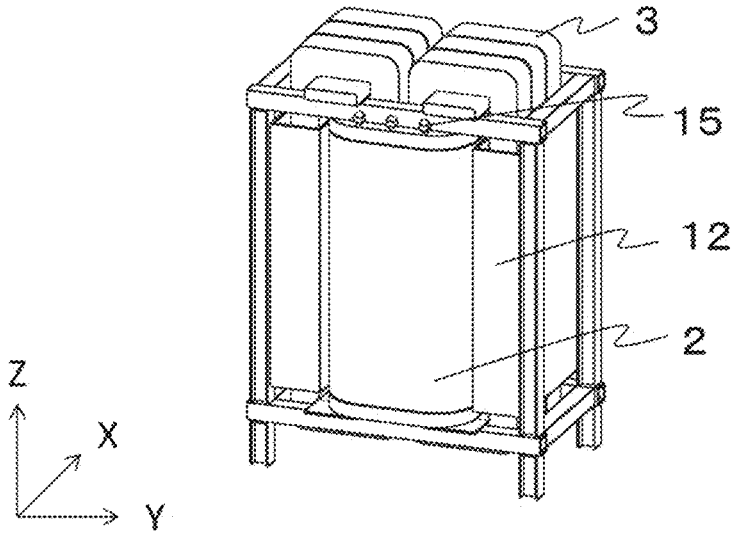
[FIG. 4A]
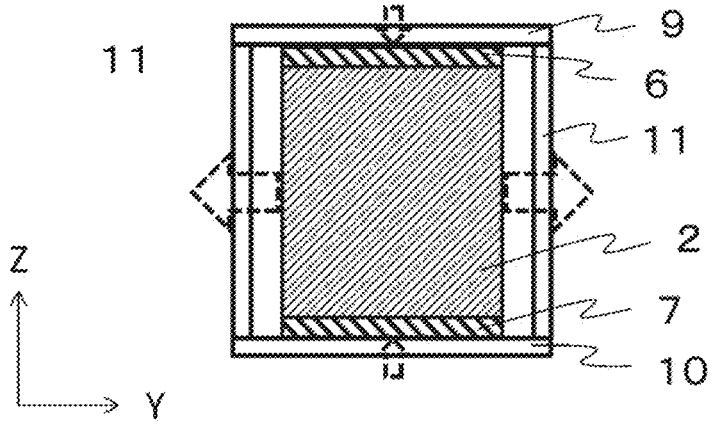

[FIG. 4B]
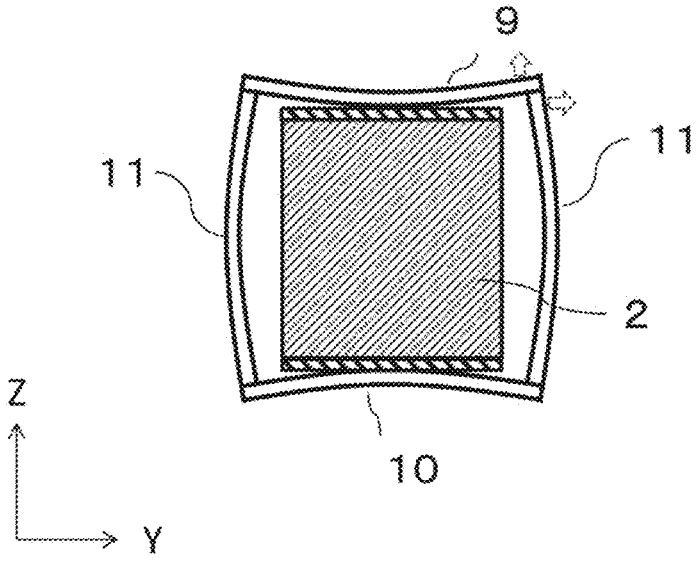
[FIG. 5]
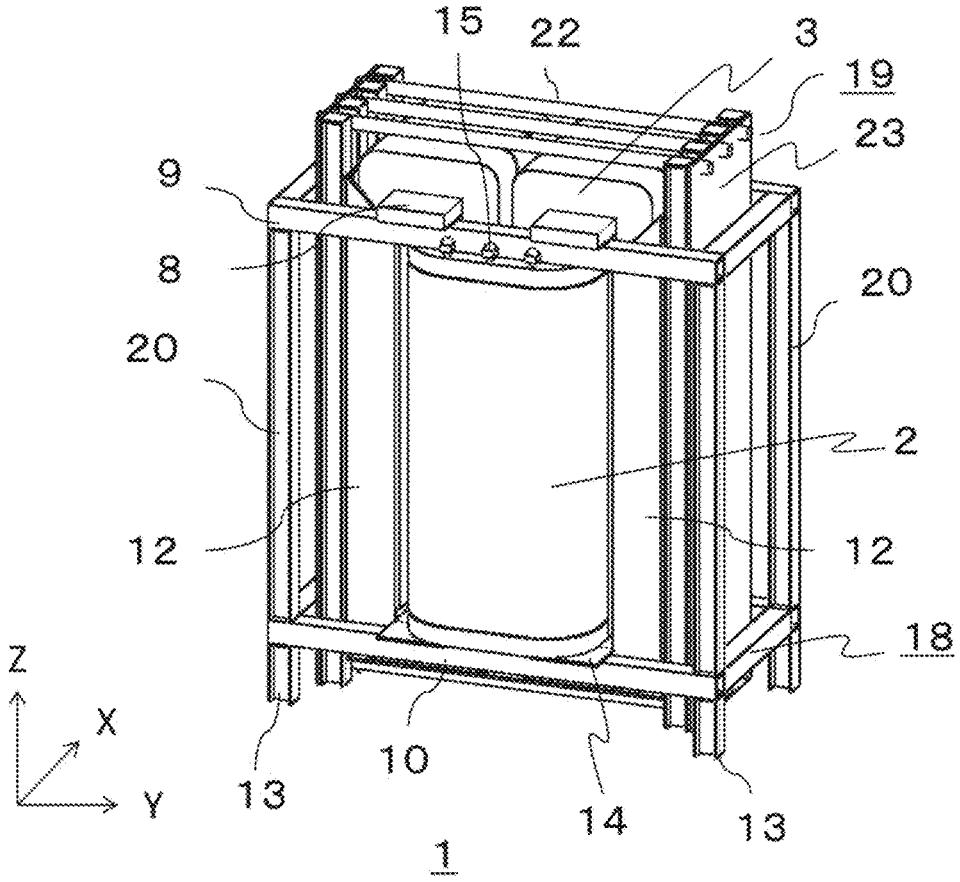

[FIG. 6A]
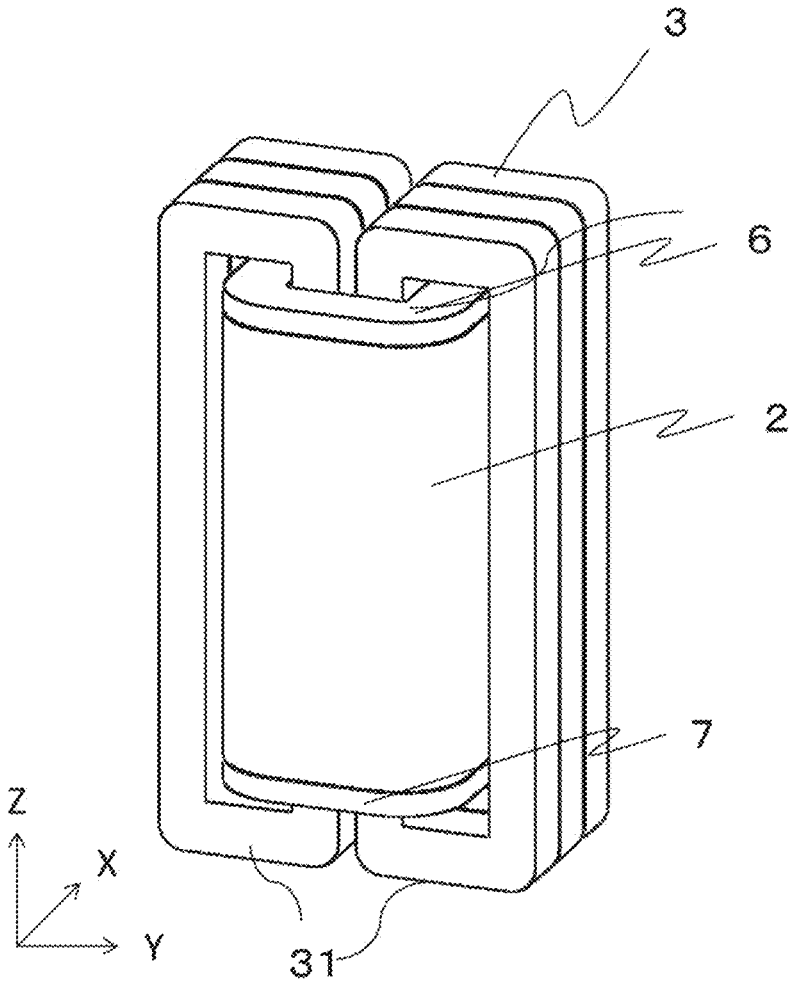
[FIG. 6B]
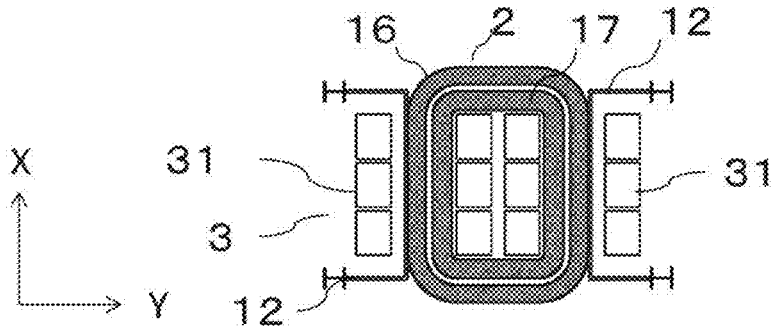

[FIG. 7]
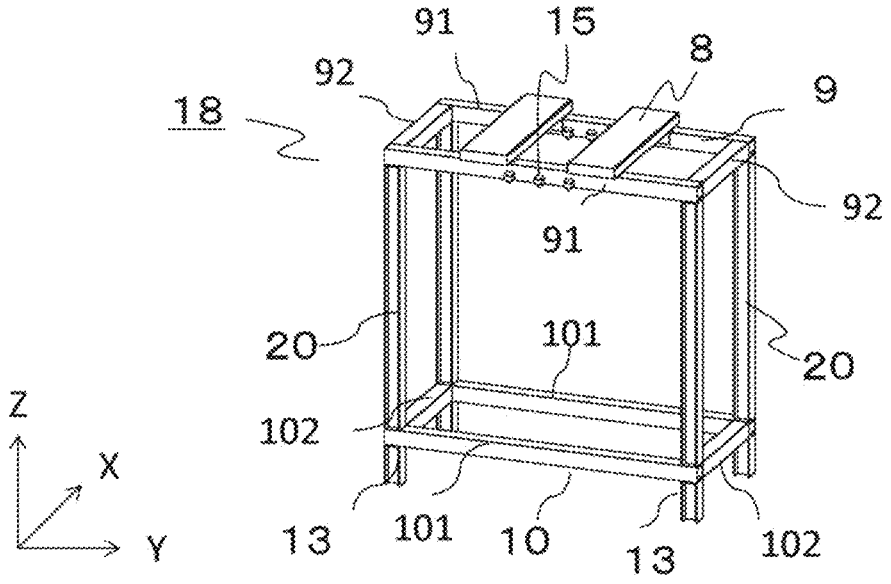
[FIG. 8]
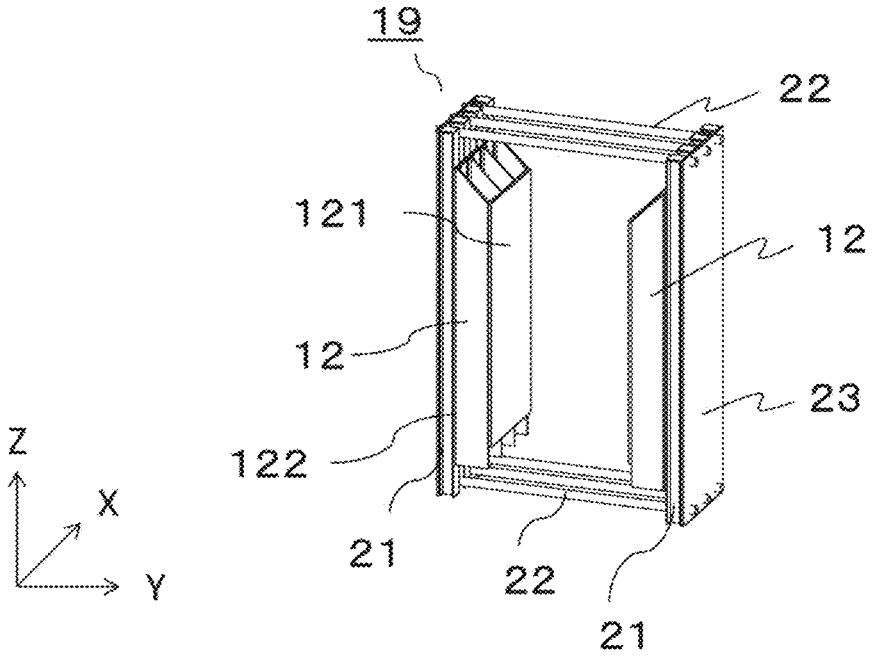

[FIG. 9A]
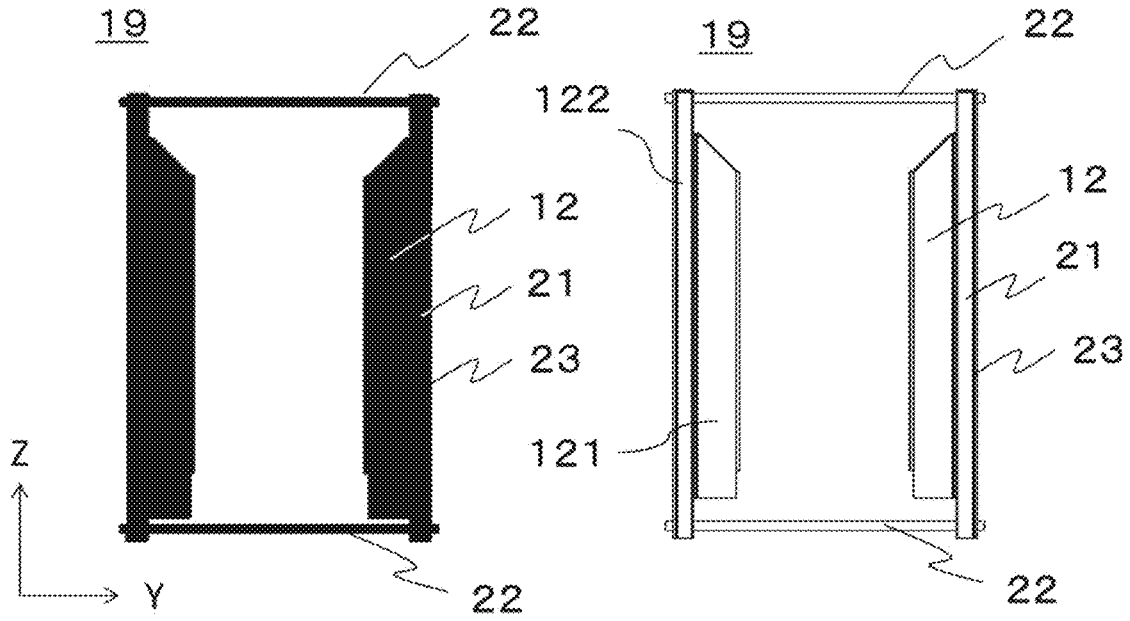
[FIG. 9B]
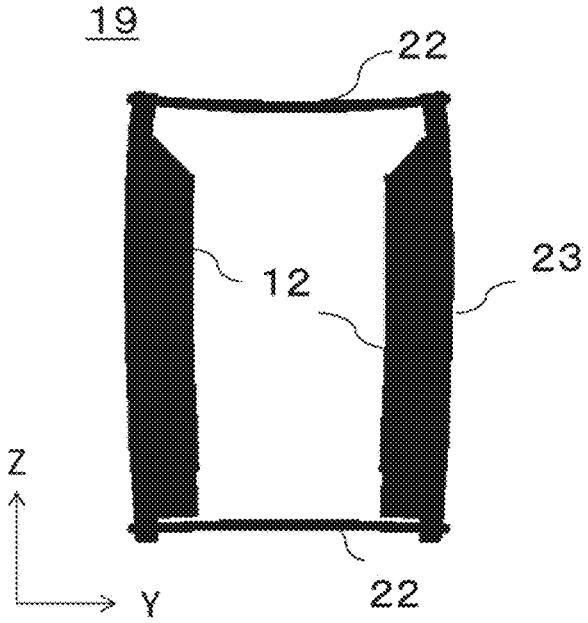

[FIG. 10A]
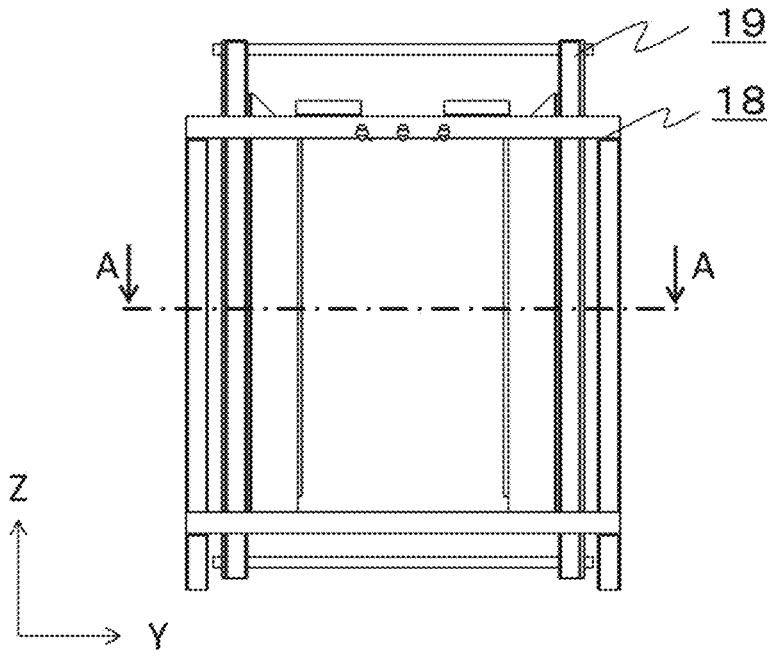
[FIG. 10B]
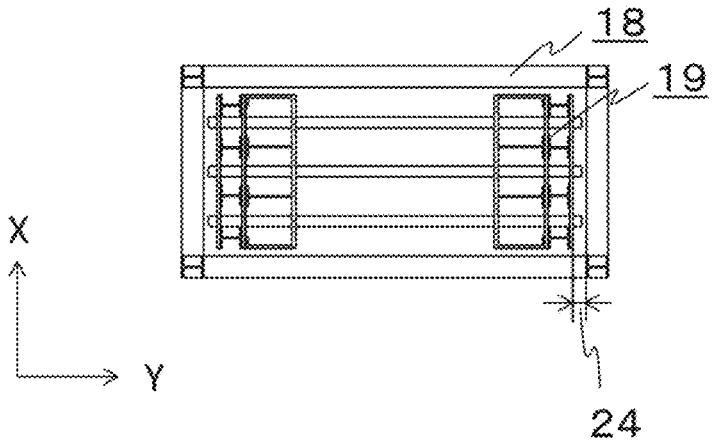

[FIG. 11A]
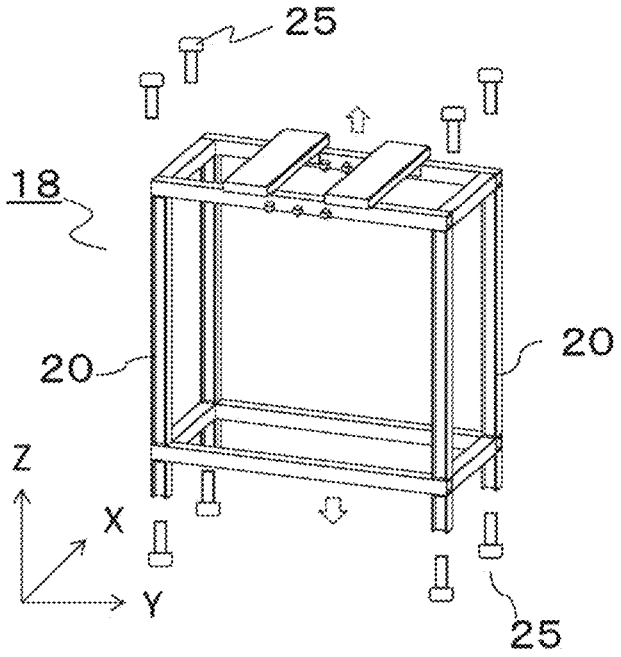
[FIG. 11B]
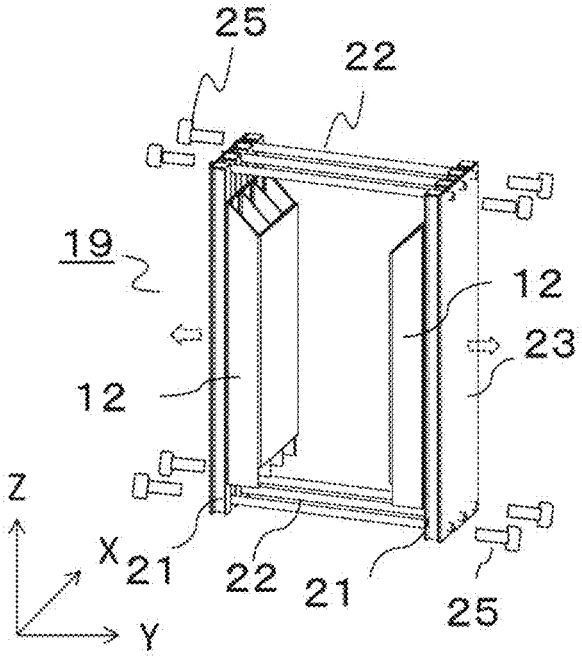

[FIG. 12]
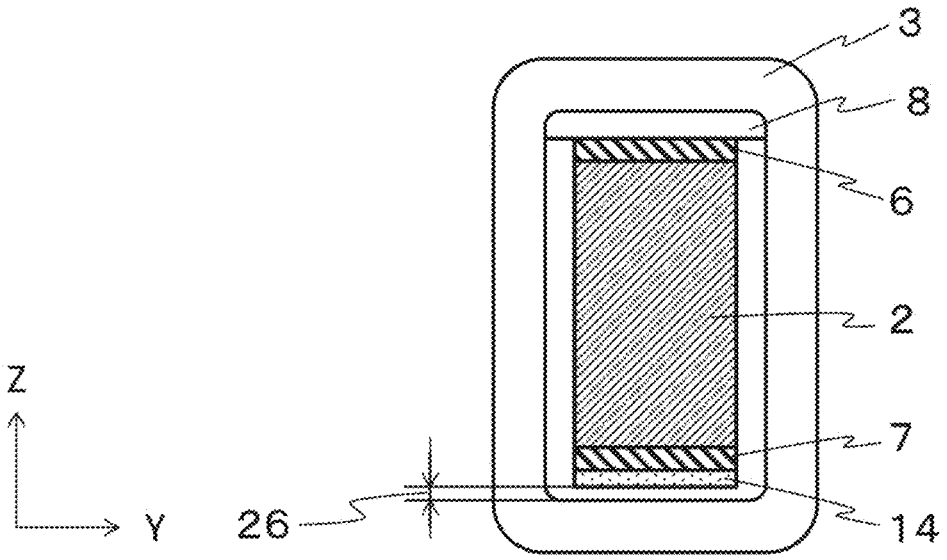
[FIG. 13]
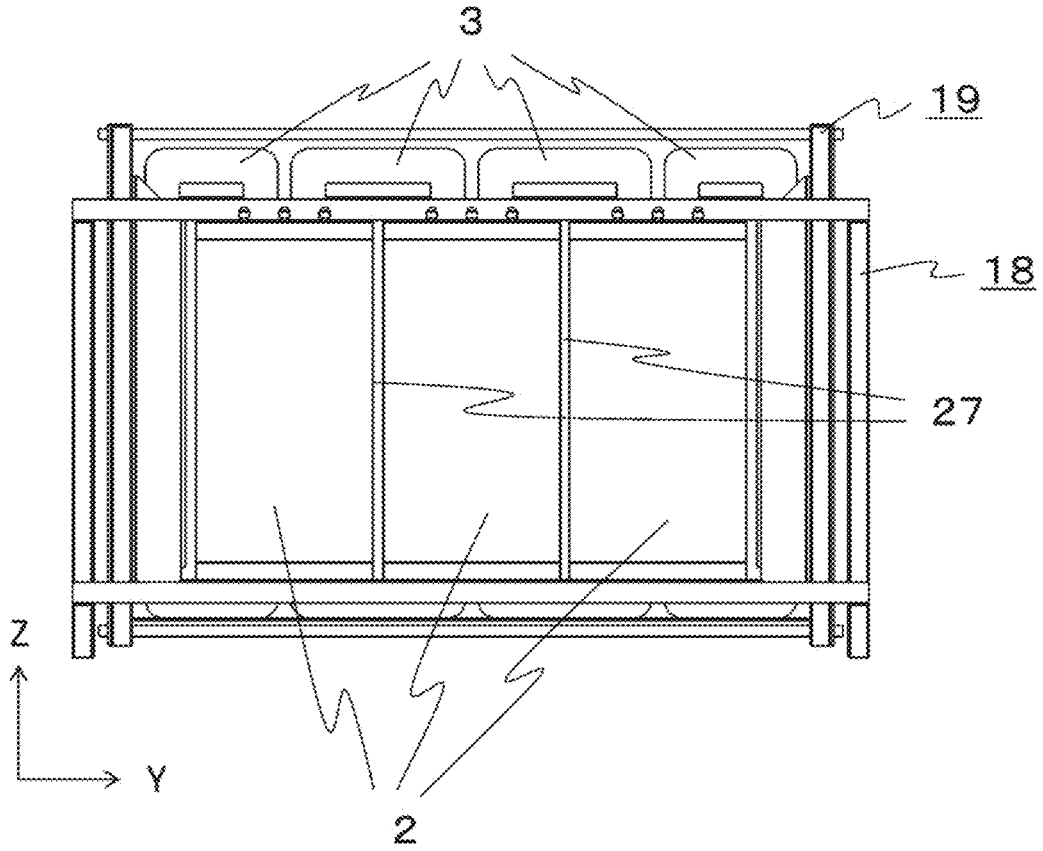

[FIG. 14]
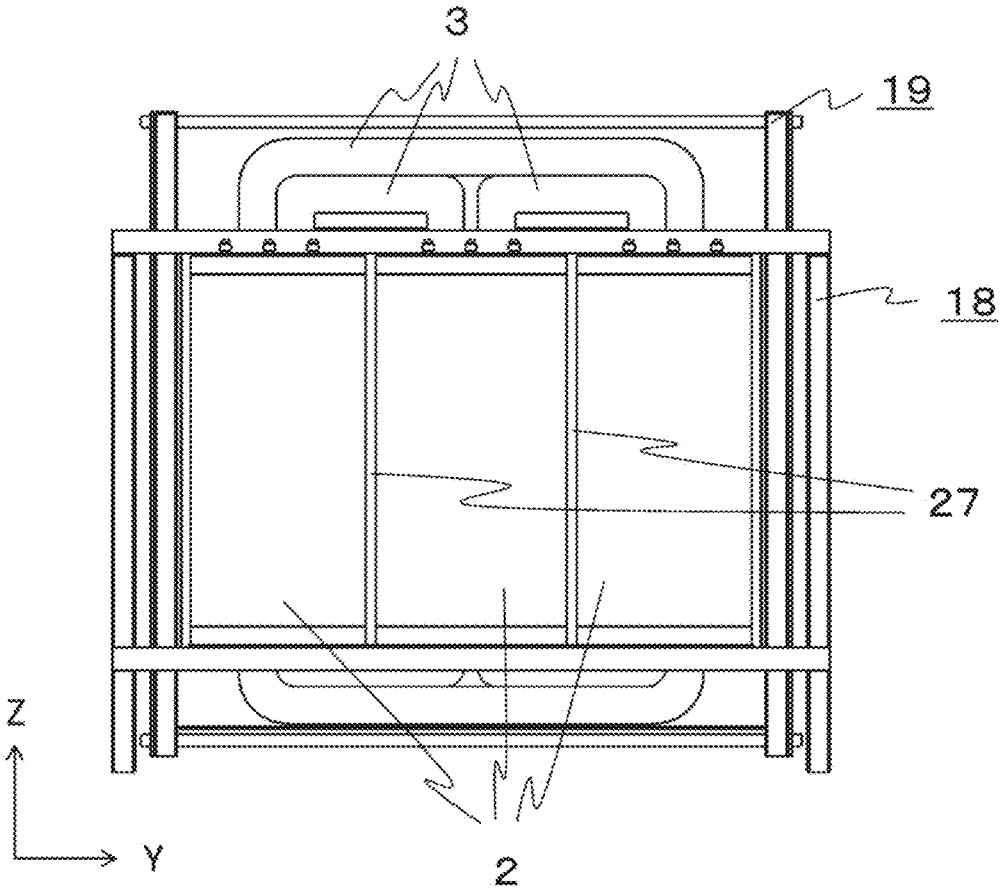

[FIG. 15]
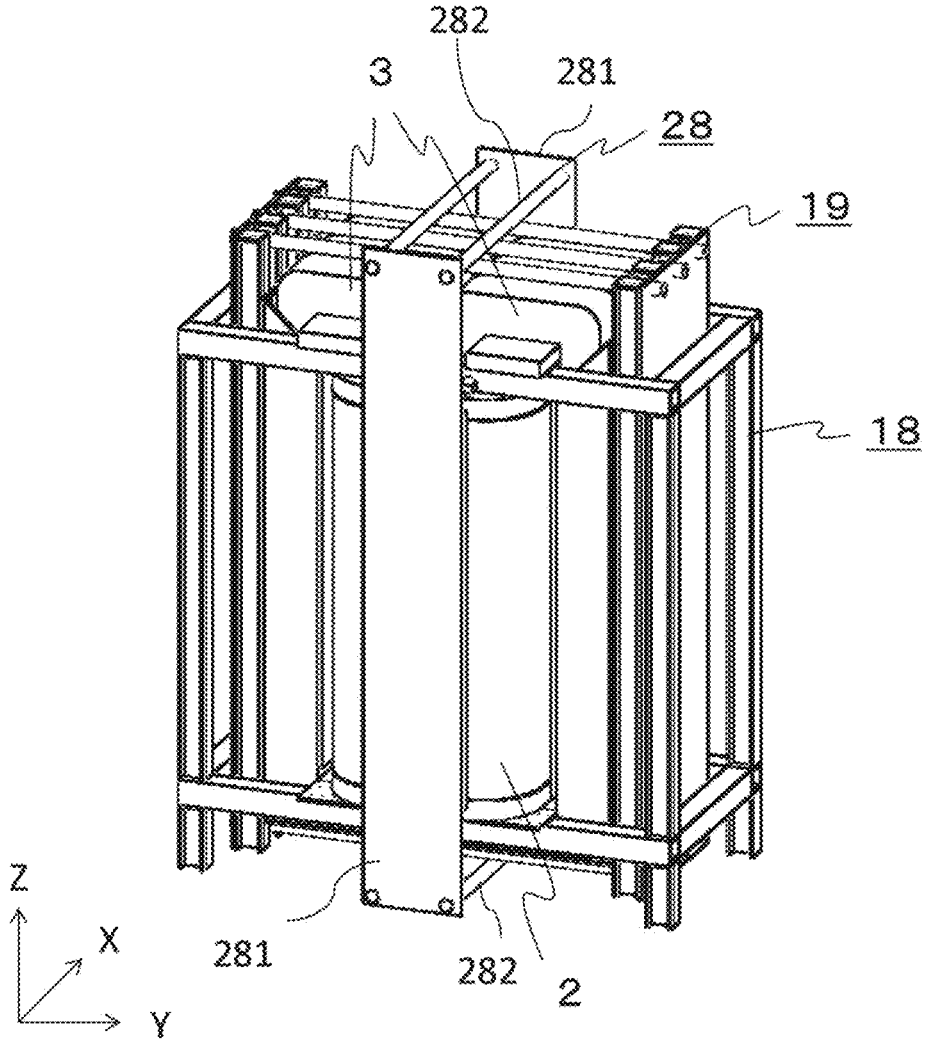

TRANSFORMER

TECHNICAL FIELD

The present invention relates to a transformer using wound iron cores.

BACKGROUND ART

A wound iron core is an iron core of a ring shape that is obtained by cutting a sheet-like or a foil-like material into a band-like shape, winding the cut band-like magnetic material in multiple layers, for example, stacking and winding tens to thousands sheets of band-like magnetic materials.

The ring shape is formed by alternately overlapping mutual end parts of every tens to hundreds sheets. This iron core member is formed of, for example, a silicon steel sheet having a thickness of hundreds of μm or an amorphous metal foil having a thickness of tens of μm.

In Patent Literature 1, it is disclosed that "a transformer including annular iron cores formed by stacking a plurality of thin bands of magnetic material and windings, wherein upper portions of the iron cores are supported by a first upper iron core supporting member disposed on first end surfaces of the upper portions of the cores in the stacking direction of the thin-bands of the magnetic material, and a second upper core supporting member disposed on second end surfaces of the upper portions of the cores, the second end surfaces being opposite to the first end surfaces of the cores; the first upper core supporting member and the second upper core supporting member extend in the longitudinal direction substantially perpendicular to the width direction of the thin bands of magnetic material of the iron core, and the cores are interposed between the first upper core supporting member and the second upper core supporting member; the first upper core supporting member and the second upper core supporting member are provided with protrusions protruding toward each other; bridging members are disposed on the protrusions of the first and second upper core supporting members; and the iron cores are supported by the bridging members." (see claim 1)

CITATION LIST

Patent Literature

PTL 1: JP-A-2013-8808

SUMMARY OF INVENTION

Technical Problem

In PTL 1 a case in which a transformer is upsized is not taken into account. A diameter of coils increases according to a capacity of the transformer. A shape of the coil changes according to a current amount, but a change amount is further increased when the diameter of the coil is large. PTL 1 does not consider a casein which a deformed coil applies a stress load to other members. Therefore, the stress load is applied to other members, and thus, a performance of the transformer may degrade.

Therefore, the present invention is to improve the performance of the transformer having wound iron cores.

Solution to Problem

A transformer according to the present invention having wound iron core which have multi-layer band-shape magnetic material, and one or more coils wound to pass through an inner periphery of the wound iron core, the transformer including:

wound iron cores holding member that is a member longer than a width of the wound iron core and supporting an upper inner portion of the wound iron core, coil holding member supporting a lower outer portion of the coil, a first support structure including an upper beam arranged on an outer periphery of the wound iron core to support the wound iron core holding member, and a lower beam arranged on an outer periphery of the coil to support the coil holding member, and a second support structure including a pair of outer plates arranged on an inner portion of the upper frame and connected to a connection member that is longer than a width obtained by adding a diameter of the wound iron core and a diameter of the coil, and an iron core protection frame body (wound iron cores protection structure) that is longer than a width of the wound iron core, for covering a portion where the outer periphery of the coil and an inner portion of the wound iron core face each other, and being connected to the outer plates.

Advantageous Effects of Invention

According to the present invention, a performance of a transformer is improved.

BRIEF DESCRIPTION OF DRAWINGS

FIG. 1 is a perspective view illustrating a structure of a three-phase and five-leg trans former using wound iron cores as an iron core.

FIG. 2A is a plan view of a coil for illustrating a force applied to the coil when the coil is short-circuited.

FIG. 2B is a front view of a coil for illustrating a force applied to the coil when the coil is short-circuited.

FIG. 3A is an exploded perspective view for illustrating a structure of a frame body supporting wound iron cores.

FIG. 3B is an assembled perspective view for illustrating a structure of a frame body supporting wound iron cores.

FIG. 4A is a diagram for illustrating a mechanism of collapsing the coil due to a force applied to the coil, when the coil of the transformer is short-circuited.

FIG. 4B is a diagram showing deformation of a coil and a support frame, when the coil of a transformer is short-circuited.

FIG. 5 is a perspective view for illustrating a structure of a single-phase and three-leg transformer according to a first embodiment of the present invention.

FIG. 6A is a perspective view showing a positional relation between a transformer coil and an iron core in the first embodiment of FIG. 5.

FIG. 6B is a cross-sectional view of a main configuration showing positional relation among the transformer coil, wound iron cores, and an iron core protection frame body of a second support frame body in the first embodiment of FIG. 5.

FIG. 7 is a perspective view showing a configuration of a first support frame body in the first embodiment of FIG. 5.

FIG. 8 is a perspective view showing a configuration of a second support frame body in the first embodiment of FIG. 5.

FIG. 9A is a diagram of a support frame before being deformed in the second support frame body of the first embodiment of FIG. 5.

FIG. 9B is a diagram showing a deformed state of the support frame in the second support frame body of the first embodiment of FIG. 5.

FIG. 10A is a diagram for illustrating a positional relation between the first support frame body of FIG. 7 and the second support frame body of FIG. 8.

FIG. 10B is a cross-sectional view taken along a line A-A of FIG. 10A, and illustrates a positional relation between the first support frame body of FIG. 7 and the second support frame body of FIG. 8.

FIG. 11A is a perspective view showing a second embodiment of the present invention, and illustrating a fastening direction of a bolt and a stud bolt used in a support frame of a first support frame body.

FIG. 11B is a perspective view showing a second embodiment of the present invention, and illustrating a fastening direction of a bolt and a stud bolt used in a support frame of a second support frame body.

FIG. 12 is a diagram showing a third embodiment of the present invention and illustrating a positional relation among a lower coil insulation plate mounted between a coil and an iron core, and a coil, a wound iron core lower insulating plate, and an iron core support plate.

FIG. 13 is a front view showing a configuration, in which the first and second support frame bodies of FIG. 5 are applied to a three-phase and three-leg transformer.

FIG. 14 is a front view showing a configuration, in which first and second frame body supporting frame bodies of FIG. 5 are applied to a three-phase and five-leg transformer.

FIG. 15 is a perspective view showing a fourth embodiment of the present invention, and illustrating a configuration, in which first, second, and third support frame bodies of the invention are applied to a single-phase and three-leg transformer.

DESCRIPTION OF EMBODIMENTS

Hereinafter, embodiments will be described with reference to the drawings. Throughout the all drawings for illustrating the embodiments, like reference signs are given to like configurations and the repetition of description therefor will be omitted. Even though written in different drawings from each other, the like reference signs are for the like elements in principle, and thus, descriptions for like reference signs described in another drawing may be omitted. Even a plan view may be hatched to make the drawing easier to understand.

A basic structure of a transformer according to the present invention will be described below with reference to FIG. 1.

FIG. 1 shows a transformer 1 of three-phase and five-leg. The transformer 1 includes an air-core coil 2 arranged on a base 5, a ring-shaped wound iron core 3 (also just referred to as wound iron core 3) passing through the air-core (hollow portion) of the coil 2, and a spacer 4 formed of an insulating material. Furthermore, the coil 2 receives a weight of the ring-shaped wound iron core 3 via the spacer 4.

In some cases, the coil 2 may be resin-molded according to an installation environment of the transformer 1, or the like. Alternatively, an insulating oil may be filled in the surroundings of the coil 2.

Here, a case of a transformer using an amorphous metal foil strip (simply referred to as an amorphous foil strip) in the member of the wound iron core 3 (simply referred to as an amorphous transformer) will be described.

The coil 2 is deformed due to the weight of the wound iron core 3. In addition, since the amorphous metal foil is fragile, the wound iron core 3 may be damaged.

In a large-sized transformer including the wound iron core 3 having a weight of about 2 t or greater, a force applied by the wound iron core 3 to the coil 2 increases. Therefore, in a case of a structure supported by the coil 2 via the spacer 4, the coil 2 receives the weight of the wound iron core 3 to be deformed. When a deformation amount of the coil is large, an insulating film of the wound iron core 3 may break and an insufficient insulating distance may occur.

In addition, when the coil 2 is short-circuited in the transformer of a large capacity, a force applied to the coil 2 is very large, for example, hundreds of tons. A magnitude of an electromagnetic force applied to the coil 2 is in proportion to a square of a magnitude of an electric current flowing in the coil when the coil is short-circuited.

The above phenomenon will be described with reference to FIGS. 2A and 2B. The force applied to the coil when the coil is short-circuit is simulated, and FIG. 2A is a plan view of the coil 2 and FIG. 2B is a front view. The coil 2 includes a primary coil 16 and a secondary coil 17. In addition, the coil 2 is a coil formed to have a rectangular cross-section (referred to as a rectangular coil or simply coil). A direction in which the force is applied to the rectangular coil when the coil 2 is short-circuited will be described.

As shown in FIG. 2A, when the coil is short-circuited, a force applied in a horizontal direction of the coil (a left-right direction in the drawing, that is, Y-axis direction) is increased. That is, the coil 2 is deformed due to the force applied in the horizontal direction. When the coil 2 is deformed and the coil 2 collides with the wound iron core 3, an amorphous metal foil body may be damaged. FIG. 2B is a front view of the coil 2.

FIG. 2B shows the force applied in a direction of compressing the coil 2 in a z-axis direction when the coil 2 is short-circuited. In addition, just as a spring is contracted, after the coil 2 is compressed, a restoration force is applied to the coil 2 in an extending direction.

Next, a structure of a support frame body that supports the wound iron core 3 will be described with reference to FIGS. 3A and 3B. FIG. 3A is an exploded perspective view showing disassembled components constituting the support frame body according to the present invention. In addition, FIG. 3B is an assembly diagram showing one support frame body constituted by combining the components of the support frame body.

The support frame body includes an upper beam 9 and a lower beam 10, pillars 11, an iron core support plate 8, a coil support plate 14, an iron core protection frame 12 (also referred to as a wound iron core protection structure 12), four legs 13, and a coil coupling bolt 15. Sizes and numbers of the pillar 11, the iron core support plate 8, the coil support plate 14, etc. may be changed adequately depending on a size or a capacity of the transformer.

The upper beam 9 is obtained by connecting a pair of shorter beams and a pair of longer beams to one another. The upper beam 9 has an air-core (hollow portion) at a center thereof so that the wound iron core 3 is inserted thereto, and has a rectangular frame. It is so-called a square ring shape, on which the iron core support plate 8 is mounted. The wound iron core 3 is mounted on the iron core support plate 8. That is, the iron core support plate 8 supporting the wound iron core 3 is arranged on the upper beam 9.

The lower beam 10 has the same shape as that of the upper beam 9. The coil supporter 14 (also referred to as a coil support plate) is mounted on the lower beam 10. The coil supporter 14 supports a bottom surface portion of the coil 2, that is, the lower beam 10 supports the coil supporter 14 and the coil supporter 14 supports the coil 2.

In other words, the upper beam 9 and the lower beam 10 have a hollow shape extending in a direction perpendicular to a width direction of a thin strip of the wound iron core 3 (horizontal direction) while making the direction as a longitudinal direction.

A hole in which the coil coupling bolt 15 is mounted is formed in a center portion of a longer beam in the upper beam 9.

The lower beam 10 supports the coil 2 via the coil supporter 14, and the upper beam 9 supports the wound iron core 3 via the iron core support plate 8.

The iron core support plate 8 includes, for example, two iron core support structures, and is installed to be bridged between longer beams of the upper beam 9, which are arranged in the horizontal direction, to be configured to receive the weight of the wound iron core 3.

The coil coupling bolt 15 pushes down the coil 2 in a state where the coil 2 and the wound iron core 3 are mounted in the support frame, and when the coil 2 is pushed down by the coil coupling bolt 15, the coil 2 is interposed between the upper beam 9 and the lower beam 10.

The coil support plate 14 includes, for example, two coil support structures, and is installed to be bridged between the longer beams of the lower beam 10, which are arranged in the horizontal direction, and is configured to receive the weight of the coil 2.

Four pillars 11 connect and couple the upper beam 9 and the lower beam 10 at four inner corners (corner portions) of the upper beam 9 and the lower beam 10.

The four legs 13 are installed at four lower corners (corner portions) of the lower beam 10. The legs 13 support the lower beam 10.

The wound iron core protection structures 12 are arranged at opposite side surfaces of the coil 2 (left and right portions of the drawing) in the support frame. The wound iron core protection structure 12 is arranged to cover a longer side of the wound iron core 3. That is, when the coil is short-circuited, the coil 2 is deformed in a horizontal direction, but the coil 2 may be prevented from being directly in contact with the wound iron core 3 by arranging the wound iron core protection structure 12. As a result, damage to the amorphous foil strip of the wound iron core 3 may be prevented. As a result, it becomes hard for damage to the wound iron core 3 to occur, which in turn contributes to the long lifespan of the transformer.

Furthermore, since the coil 2 does not apply a stress load to a side surface portion of the wound iron core 3, the wound iron core 3 is not distorted and characteristics of the iron core is improved, which contributes to improving a performance of the entire transformer.

An upper coil insulation member 6 and a lower coil insulation member 7 are arranged in a gap between the wound iron core 3 and the coil 2. As a result, an insulating property between the wound iron core 3 and the coil 2 can be improved. It is also possible for the upper coil insulation member 6 and the lower coil insulation member 7 to be integrated with the coil 2 without making themselves separate members from the coil 2.

As described above, according to the structure in which the iron core support plate 8 receives the weight of the wound iron core 3 and the coil support plate 14 receives the weight of the coil 2, the coil coupling bolt 15 attached to the upper beam 9 presses the coil 2 in a perpendicularly downward direction, and thus, expansion of the coil in the perpendicular direction (Z-axis direction) at the time of the coil being short-circuited may be restricted by the upper beam 9 and the lower beam 10 via the upper coil insulation member 6 arranged on an upper part of the coil 2 and the lower coil insulation member 7 arranged on a lower part of the coil 2.

According to the structure in which the wound iron core protection structure 12 is provided at a horizontal direction surface of the coil 2, expansion of the coil 2 in the horizontal direction at the time of the coil being short-circuited can be restricted.

When the coil 2 is expanded or deformed in the horizontal direction, a force is applied to the wound iron core protection structure 12 covering the wound iron core 3. The above expanding force of the coil is transferred to the pillars 11 through the wound iron core protection structure 12. The force is mainly transferred to the pillars 11 without transferring to the wound iron core 3, and thus, damage to the wound iron core 3 may be prevented.

FIG. 4A is a diagram illustrating forces applied to the coil 2 when the coil 2 of the transformer 1 accommodated in the frame body shown in FIGS. 3A and 3B is short-circuited, and FIG. 4B is a diagram illustrating a mechanism of deforming the frame body and collapsing the coil 2 due to the force applied to the coil 2, and illustrating deformation of the coil and the support frame body.

When the coil is short-circuited, the coil 2 expands or deforms. The forces represented by arrows of FIG. 4A, that is, forces expanding in the horizontal direction of the coil 2 (left-right direction of the drawing, Y-axis direction) and forces compressing the coil 2 in an up-down direction (Z-axis direction) are applied to the coil 2.

The above forces expanding in the horizontal direction of the coil 2 are greater than the forces between which the coil 2 is interposed in the up-down direction. The magnitude of the forces is represented by the thickness of the arrows. The forces expanding horizontally are also applied to the pillars 11 via the wound iron core protection structure 12.

The force expanding in the horizontal direction of the coil 2 widens the pillars 11 outwardly while bending the pillars 11 in a bow-shape. Therefore, upper and lower surface sides of the support frame body (the upper beam 9 and the lower beam 10) contract in a perpendicular direction. This force is superimposed on the force by which the coil itself is to contract in the perpendicular direction, and as shown in FIG. 4B, deforms the upper and lower sides of the coil 2 and the support frame body (the upper beam 9, the lower beam 10, and the pillars 11) are deformed and collapses the coil 2.

In addition, at portions where the pillars 11 of the support frame body are connected with the upper beam 9 and the lower beam 10 (support frame connecting portion), a force acting on the coil 2 in the vertical direction (Z-axis direction) and a force acting on the coil 2 in the horizontal direction (direction perpendicular to the vertical direction, Y-axis direction) when the coil is short-circuited are superimposed on each other.

The support frame connecting portion needs to be very robust in order to resist against the superimposed forces. In order to make the connecting portion robust, it is often necessary to take measures such as increasing a connection area, which leads to enlargement of the support frame body.

Examples of a structure addressing the above issue will be described below.

First Embodiment

Hereinafter, the first embodiment will be described with reference to FIGS. 5 to 10. In the first embodiment, two frame bodies (hereinafter, referred to as first and second support frame bodies) supporting the wound iron core 3 and the coil 2 will be described. The support frame body preferably includes a metal member.

FIG. 5 is a perspective view showing the first embodiment, and illustrating a configuration example, in which a single-phase and three-leg transformer 1 is supported by a first support frame body 18 (also referred to as a first support structure) and a second support frame body 19 (also referred to as a second support structure). The first support structure 18 and the second support structure 19 are independent without connecting to each other. In the present specification, 'independent' denotes a state in which two members are not fixed by means of such unit as screws, bolts, or welding.

The first support structure 18 and the second support structure 19 are installed, and when the coil 2 is short-circuited, after the coil is contracted in the vertical direction, the force of stretching the coil due to the restoration force is restricted by the first support structure 18, the upper beam 9, and the lower beam 10.

Furthermore, when the coil 2 is short-circuited, the force of expanding in the horizontal direction (Y-axis direction) is received by the second support structure 19.

In other words, the first and second support structures 18 and 19 are independently configured in consideration of the force applied in the vertical direction of the coil and the force applied in the horizontal direction of the coil, which are generated when the coil 2 is short-circuited, and the second support structure 19 is arranged to surround (accommodate) the coil 2 and the wound iron core 3 and the first support structure 18 is arranged to surround (accommodate) the second support structure 19, so that the force applied to each support frame body does not interfere with another support frame body.

The first support structure 18 accommodates the transformer 1, and is formed to surround the coil 2 and the wound iron core 3 of the transformer from upper and lower sides, left and right sides, and front and rear sides. Furthermore, the upper beam 9 supports the coil 2 and the lower beam 10 supports the wound iron core 3, and they receive the wound iron core 3, the weight of the coil 2, and the force applied in the vertical direction generated when the coil is short-circuited.

The second support structure 19 is arranged in the first support structure 18 to surround the coil 2 and the wound iron core 3 (upper and lower sides, left and right sides, and front and back sides), and is arranged to receive the force applied in the horizontal direction of the coil 2 when the coil is short-circuited.

That is, when seen in a Z-Y plane, the wound iron core 3, the coil 2, the second support structure 19, and the first support structure 18 are arranged in this order from a center of the transformer 1.

The second support structure 19 is arranged so that a side surface portion thereof may be held between the wound iron core 3 and a side surface portion of the first support structure 18.

Since the first support structure 18 and the second support structure 19 are independent from each other, in a case where the force is applied to the coil 2, a Y-axis direction component in the force is received by the first support structure 18 and an X-axis direction component is received by the second support structure 19. The first support structure 18 can move in any one of the Y-axis, and the Y-axis component does not apply a load (stress) to the second support structure 19.

Since there is a gap between the first support structure 18 and the second support structure 19, the force is not transferred, and even when the coil 2 is deformed in the Y-axis direction, the first support structure 18 is not affected.

Furthermore, during the operation of the transformer 1, even when the wound iron core 3 or the coil 2 vibrates, the first support structure 18 vibrates in the Y-axis direction, and thus, influence is small as long as the first support structure 18 does not collide with the second support structure 19.

FIG. 6A is a perspective view showing a positional relation between the coil 2 and the wound iron core 3 of the transformer 1 according to the first embodiment illustrated in FIG. 5. FIG. 6B is a cross-sectional view showing a main configuration of a positional relation between the coil 2 and the wound iron core 3 (a plurality of wound iron cores 31) of the transformer 1, and the wound iron core protection structure 12 of the second support frame body 19.

The wound iron core 3 includes a plurality of wound iron cores 31, and is formed by laminating amorphous foil strips in a ring shape as described above. The plurality of wound iron cores 31 are wound around the coil 2. The wound iron cores 31 are wound while passing through the inside of the coil 2. Furthermore, the wound iron core 3 includes the plurality of wound iron cores 31 in the drawings, but may include a single wound iron core 31.

The wound iron core 3 may be divided into a plurality of pieces in a thickness direction (lamination layer thickness direction) or a width direction of the lamination. In the present embodiment, the coil 2 has a horizontal cross-section of a square shape, but the coil 2 may have other cross-sectional shapes.

The upper coil insulation member 6 and the lower coil insulation member 7 are arranged between upper and lower portions of the coil 2 and the wound iron core 3. The upper coil insulation member 6 and the lower coil insulation member 7 electrically insulate the coil 2 and the wound iron core 3 or the coil 2 and the iron core support plate 8 from each other.

The coil 2 includes a primary coil 16 and a secondary coil 17. As shown in FIG. 6B, the wound iron core protection structure 12 of the second support frame body 19 is partially arranged between the wound iron core 3 (the plurality of wound iron cores 31) and the primary coil 16.

The wound iron core protection structure 12 surrounds the wound iron core 3 having the plurality of wound iron cores 31. When the coil 2 expands or deforms and deformation amounts at a center, an upper portion, and a lower portion of the coil 2 are different from one another, the coil 2 can be restrained from directly pressing the wound iron core 3. Thus, the wound iron core 3 can be protected.

FIG. 7 is a perspective view showing a configuration example of the first support structure 18.

The first support structure 18 includes the iron core support plate 8, the upper beam 9, the lower beam 10, pillars 20, legs 13, and the coil coupling bolt 15.

The upper beam 9 is formed by connecting a pair of longer beams 91 and a pair of shorter beams 92 as shown in the drawing to form a square shape extending in a left-right direction having a void (air-core) to which the wound iron core 3 is inserted, that is, is formed as a square ring shape.

The lower beam 10 includes a pair of longer beams 101 and a pair of shorter beams 102, and has the same shape as the upper beam 9.

That is, the upper beam 9 and the lower beam 10 form a hollow shape extending in a direction perpendicular to a width direction of the amorphous foil strip of the wound iron core 3 while making the direction as a longitudinal direction thereof.

A hole in which the coil coupling bolt 15 is mounted is formed in a center portion of a longer beam 91 in the upper beam 9. The hole may include, for example, a plurality of (two or more) holes.

The coil coupling bolt 15 is coupled to the hole to press the coil 2. When the coil 2 is pressed by the coil coupling bolt 15, the pair of longer beams 91 and the longer beams 101 of the upper beam 9 and the lower beam 10 interpose the coil 2 therebetween.

The iron core support plate 8 (also referred to as wound iron core support structure or wound iron core holding member) is arranged so as to be bridged between the longer beams 91 of the upper beam 9, and is mounted at an air-core portion of the wound iron core 3 to receive the weight of the wound iron core 3. The iron core support plate 8 may be divided as a plurality of pieces.

The coil support plate 14 (see FIG. 5) is omitted in FIG. 7, but is arranged so as to be bridged between the longer beams 101 of the lower beam 10 to receive the weight of the coil 2.

Four pillars 20 face and are positioned at inner four corners (corner portions) of the upper beam 9 and the lower beam 10, and connect the upper beam 9 and the lower beam 10 to each other. The four legs 13 are attached to lower four corners (corner portions) of the lower beam 10. A length of the leg 13 may correspond to a height at which the wound iron core 3 is not installed. That is, the leg 13 is longer than a length from the lower coil insulation member 7 to a lower portion of the wound iron core 3. As a result, the wound iron core 3 is supported by the iron core support plate 8, and the side surface portion is in a state of being suspended. Therefore, distortion of the lower portion of the wound iron core 3 hardly occurs, and characteristics of the wound iron core 3 are improved.

Furthermore, the coil 2 is supported by the coil support plate 14, and the wound iron core 3 is supported and suspended by the iron core support plate 8.

Therefore, when the length of the upper coil insulation member 6, the coil 2, the lower coil insulation member 7, and the coil support plate 14 is smaller than the length between a lower surface of the upper portion of the wound iron core 3 and an upper surface of the lower portion of the wound iron core 3, the coil 2 and an inner portion of the wound iron core 3 are not in contact with each other in the vertical direction.

Due to the above configuration, the coil 2 does not apply stress on the wound iron core 3 in the vertical direction, and distortion of the wound iron core 3 hardly occurs and characteristics of the wound iron core can be improved.

The coil coupling bolt 15 can be adjusted to press the coil 2 in vertically downward direction from its installation position. Therefore, expansion of the coil 2 in the vertical direction occurring when the coil is short-circuited can be restrained.

Here, the pillars 20 may be constituted with a stud bolt so as to vary and adjust a distance between the upper beam 9 and the lower beam 10.

In this case, even in a case where the coil 2 is fastened by a configuration of varying and adjusting a height representing the stud bolt, the same effect as that of a case in which the coil coupling bolt 15 is used can be expected to be obtained.

Furthermore, by providing the configuration in which the height of the pillar 20 is adjustable, the height of the pillar 20 can be increased after assembling the coil 2 and the wound iron core 3. Accordingly, by raising the position of the iron core support plate 8 based on a floor on which the legs 13 are placed or a bottom surface with which the transformer 1 is in contact, the wound iron core 3 can be lifted upward.

That is, even in a case where the coil 2 and the wound iron core 3 are in contact with each other and distortion of the wound iron core 3 occurs during the assembling operation, the position of the iron core support plate 8 can be changed to make the coil 2 and the wound iron core 3 not in contact with each other, and the distortion of the wound iron core 3 can be eliminated.

FIG. 8 is a perspective view showing a configuration example of the second support structure 19 in the first embodiment of FIG. 5.

The second support structure 19 is arranged at a location of holding opposite side surfaces of the wound iron core 3, and has a function of restraining the coil 2 from expanding in the horizontal direction when the coil 2 is short-circuited by receiving the force of the horizontal direction described above.

The second support structure 19 includes the wound iron core protection structure 12 including a surface 121 located between the wound iron cores 31 of the wound iron core 3 and the primary coil 16 of the coil 2. In addition, the second support structure 19 includes pillars 21 arranged on an outer portion of the wound iron core protection structure 12, outer plates 23 mounted on the pillars 21 to support the wound iron core protection structure 12, and stud bolts 22 that are connection members for connecting the outer plates 23 at their upper and lower portions. An internal frame body plate 121 and an outer frame body plate 122 are connected to the outer plates 23.

The wound iron core support plate 8 (also referred to as the wound iron core support structure 8) is a member supporting an inner upper portion of the wound iron core 3 and has a length longer than a width of the wound iron core 3. The coil support plate 14 supports an outer portion, that is, an outer circumferential side of the lower portion of the coil 2, and is longer than a diameter of the coil.

In addition, the wound iron core support structure 8 may be divided into two or more pieces, or may be smaller than the diameter of the coil 2, provided that the wound iron core support structure 8 has such a size that it can be mounted on the facing upper beam 9.

In addition, the upper beam 9 (also referred to as an upper frame 9) is arranged on an outer periphery of the wound iron core 3, and supports the wound iron core support structure 8. The lower beam 10 (also referred to as a lower frame 10) is arranged on an outer periphery of the coil 2, and supports the coil holding member 14.

The upper beam 9 and the lower beam 10 preferably includes at least two members so that the wound iron core support structure 8 or the coil support plate 14 can be placed thereon. It may be an H-shape connecting two members or a frame shape including four members. Furthermore, in order to increase strength, a plurality of rod-shape members may be connected as a ladder shape.

At least the first support structure 18 includes the upper beam 9 and the lower beam 10. In addition, the legs 13 extend from the lower beam 10 towards the bottom surface or the installation floor of the transformer 1. The legs 13 may have lengths that may not allow a bottom of the wound iron core 3 to contact the bottom surface or the installation floor of the transformer 1.

Alternatively, the wound iron core may be in contact with the floor in order to prevent deformation of the wound iron core 3. The floor may be installed via another member, and may be a tank in a case where the wound iron core 3 is enclosed in an insulating oil. In addition, the lower beam 10 may be stretched towards the floor without using the legs 13.

Next, the second support structure 19 will be described below.

The second support structure 19 includes at least a pair of outer plates 23, the stud bolt 22, and the wound iron core protection structure 12.

The outer plates 23 are arranged inside the upper beam 9. A height of the outer plate 23 is greater than a length of the wound iron core 3 in the vertical direction. Furthermore, a distance between the pair of outer plates 23 is greater than a length obtained by adding the diameters of the wound iron core 3 and the coil 2. The outer plates 23 are connected to each other via a connection member that adjusts a horizontal width, such as the stud bolt 22, or the like.

The wound iron core protection structure 12 connected to the outer plate 23 covers a portion where the outer periphery of the coil 2 and the inner side of the wound iron core 3 face each other. In addition, a width of the wound iron core protection structure 12 is greater than the width of the wound iron core 3 in order to form a structure covering the wound iron core 3.

Furthermore, a bottom surface of the second support structure 19 is at a height that is the same as or higher than the bottom surface. Since the bottom surface of the second support structure 19 is not in contact with the floor, independence of the first support structure 18 and the second support structure 19 is improved.

The wound iron core protection structure 12 includes a wound iron core protection surface 121 arranged inside the wound iron core 3, a surface protecting the side surface portion of the wound iron core, and an outer frame body plate 122 connected to the outer plates 23.

The outer frame body plate 122 may be omitted provided that a sufficient strength may be obtained when the wound iron core protection structure 12 and the stud bolt 22 are mounted on the outer plates 23. That is, the surface protecting the side surface portion of the wound iron core may be directly connected to the outer plates 23. In this case, a lightweight may be achieved.

In addition, an upper portion of the wound iron core protection structure 12 is configured so that a side of the inner frame body plate 121 is shorter than a side of the outer frame body plate 122. This denotes that the outer frame body plate 122 is longer than the inner frame body plate 121, and thus, a connecting portion between the outer plates 23 and the outer frame body plate 122 becomes greater and a rigidity may be improved.

In a case where the coil 2 is deformed, a deformation component in the Z-axis direction may be received by the first support structure 18 because the first support structure 18 and the second support structure 19 do not interfere with each other when the coil 2 mounted on the coil support plate 14 has such a height that the coil 2 does not contact the upper inner portion of the wound iron core 3.

Furthermore, when the coil 2 is deformed, it is brought into contact with the iron core protection frame body 12 via an insulating material, and the deformation of the coil 2 does not affect the wound iron core 3, and thus, a deformation component in the Y-axis direction does not apply the distortion to the wound iron core 3. Accordingly, when compared with a case in which the deformation of the coil 2 affects the wound iron core 3, the characteristics of the iron core can be improved.

The first support structure 18 and the second support structure 19 are not fixed or held by screws, bolts, or the like. In a case where the coil 2 is deformed due to an electric current flowing therethrough or short-circuit, the second support structure 19 is movable or vibrated in the Y-axis direction independently from the first support structure 18, according to the Y-axis direction component. The first support structure 18 is less affected, for it is independent.

A gap is provided between the upper surface of the coil support plate 14 and a lower inner portion of the wound iron core 3. Therefore, the bottom surface of the coil 2 and the lower inner portion of the wound iron core 3 are independent from each other without contacting each other, and the coil 2 does not distort the wound iron core 3.

Furthermore, a gap may be provided between the upper surface of the coil 2 and a bottom surface of the iron core support plate 8. The upper surface of the coil 2 is not in contact with the upper inner portion of the wound iron core 3.

The stud bolt 22 may be replaced with a plate-shape or a rod-shape member or a horizontal width adjusting member.

The wound iron core protection structure 12 is configured to restrain the force applied in the horizontal direction. A plate-shape member is folded as a rectangular shape, and is formed as a hollow box shape including the surface 121 protruding to face the side surface of the coil, as shown in FIG. 6B. The protruding surface 121 is provided to be located between the wound iron core 3 and the coil 2. It is configured to restrain expansion of the coil 2 in the horizontal direction in a case where the coil 2 is short-circuited.

That is, the wound iron core protection structure 12 may have any kind of shape, provided that the wound iron core protection structure 12 is configured to restrain the expansion of the coil 2 in the horizontal direction.

In the present embodiment, the wound iron core protection structure 12 includes a plate frame body portion including the inner frame body plate 121 and the outer frame body plate 122.

The plate frame body portion has a cylindrical shape including the inner frame body plate 121 and the outer frame body plate 122, and a part of the wound iron core 3 is mounted at a cavity of the cylindrical shape.

In other words, the inner frame body plate 121 and the outer frame body plate 122 of the plate frame body portion are arranged to surround a part of the outer portion of the wound iron core 3 to protect the wound iron core 3.

The inner frame body plate 121, for example, is formed by bending a plate material as an elongated rectangular shape, and thus, as shown in FIG. 6B, a leading end surface of the inner frame body plate 121 is arranged to face the side surface of the coil 2 by being mounted between the coil 2 and the wound iron core 3.

Here, a predetermined gap is provided between the wound iron core protection structure 12 and the wound iron core 3, as will be described later. In addition, even in a case where the coil 2 and the wound iron core protection structure 12 are deformed due to the force applied when the coil 2 is short-circuited, they do not collide with the wound iron core 3 so as not to break the wound iron core 3.

Next, in a case where the first support structure 18 and the second support structure 19 are separately provided, effects of the second support structure 19 will be described.

FIG. 9 is a diagram illustrating a shape of the second support structure 19 before and after deformation in the first embodiment of FIG. 5. FIG. 9A is a diagram showing the second support structure 19 before being deformed. In addition, FIG. 9B is a diagram showing a displacement of the second support structure 19, which is enlarged by 20 times greater, after the second support structure 19 is deformed due to the force of the horizontal direction when the coil 2 is short-circuited. A blackened part in the drawing represents that a varied portion is included.

A maximum displacement of the second support structure 19 at the time of the coil being short-circuited is estimated according to a numerical analysis result of the displacement portion (blackened portion) of the second support structure 19 after the deformation, and a size of the gap between the wound iron core protection structure 12 and the wound iron core is set to be equal to or greater than the estimated displacement.

The force supported by the first support structure 18 is the mass of the wound iron core 3: 7 t, the mass of the coil 2: 3 t, and the force in the vertical direction when the coil is short-circuited: 20 t at the maximum. In addition, the force supported by the second support structure 19 was 115 t in the horizontal direction when the coil is short-circuited, and the maximum displacement in the horizontal direction was found to be 3.7 mm in the horizontal direction.

In this case, the first support structure 18 and the second support structure 19 may be preferably arranged with a gap of about 5 mm provided therebetween.

From the above analysis result, it could be proved that the first and second support structures 18 and 19 do not interfere with each other when the coil is short-circuited, that even when the second support structure 19 is deformed, there is no risk of collapsing the coil 2 due to the mechanism illustrated in FIGS. 4A and 4B, and that deformation or insulation breakage of the coil 2 can be prevented.

This denotes that, in the configuration in which the first and second support structures 18 and 19 are independently provided, a part of the force generated when the coil is short-circuited may be absorbed by the deformation of the second support structure 19. That is, the above effect may be considered to be caused from a fact that the support structure is divided into the first and second members and the second support structure 19 may have a tolerance degree with respect to the deformation.

FIG. 10 is diagrams illustrating a positional relation between the first support frame body 18 of FIG. 7 and the second support structure 19 of FIG. 8, wherein FIG. 10A is a front view showing the second support structure 19 assembled with the first support structure 18, and FIG. 10B is a cross-sectional of A-A view taken along a line A-A of FIG. 1A.

The second support structure 19 is arranged on an inner side of the first support structure 18 on a cross-section of A-A, in order to restrain the displacement of the side surface of the coil in the horizontal direction during the short-circuiting of the coil.

Further, a gap 24 having a constant size (distance) in the horizontal direction is generated in several places between the first support structure 18 and the second support structure 19, so that the second support structure 19 does not interfere with the first support structure 18 when the second support structure 19 is displaced in the horizontal direction due to the short-circuit of the coil 2. The size (distance) of the gap 24 is obtained by analyzing the above estimated displacement. As an example obtained earlier, the gap 24 may preferably have a size of 5 mm. Alternatively, the gap 24 may be about 10 mm, or 100 mm or less. This is much smaller value compared with a total width of the transformer 1, and is effective. Alternatively, when the gap is about 500 mm or less, it may be sufficiently implemented.

In addition, when the gap is about 5% or less of the total width of the transformer 1, the gap is sufficiently small compared with the entire size of the transformer 1, and thus, it maybe implemented. In addition, the gap may be 5% or greater and 10% or less of the total width of the transformer 1, but it is preferable that the gap is 5% or less taking into account smallization of the entire transformer 1.

Furthermore, the wound iron core protection structure 12 and the outer plates 23 of the second support structure 19 are hardly displaced in the vertical direction even when the coil is short-circuited, and there is a gap, by which the first and second support structures 18 and 19 are not in contact with each other even when the first and second support structures 18 and 19 approach each other in the vertical direction.

According to the above-described embodiment, damage to the wound iron core 3 due to the coil 2 and peripheral members thereof colliding with the wound iron core 3 may be prevented, when the coil 2 is short-circuited. In addition, collapsing of the coil 2 or insulation breakage of the coil 2 due to the deformation of the coil 2, and the first and second support structures 18 and 19 may be prevented. In addition, damage to the first and second support structures 18 and 19 due to superimposition of the forces in the support frame may be avoided.

The present embodiment illustrates the single-phase three-leg transformer as an example, but may be also applied to a three-phase and five-leg transformer and three-phase and three-leg transformer as illustrated in FIGS. 13 and 14. In addition, even when the number of coil 2 and the number of wound iron core 3 are different from each other, the first support structure 18 and the second support structure 19 are separately provided to obtain the same effects as those of the present embodiment. In the same drawings, a coil insulation member 27 is provided among a plurality of coils 2.

Second Embodiment

According to the present embodiment, in the first support structure 18 and the second support structure 19 of the first embodiment, bolts 25 are used to reinforce a support frame connecting portion of the support structures.

FIG. 11A is a perspective view illustrating the second embodiment of the present invention, and illustrating a coupling direction of the bolts 25 used in the first support structure 18. FIG. 11B is a perspective view illustrating the stud bolt 22 used in the second support structure 19 and a coupling direction of the stud bolt 22. Referring to the same drawings, elements that are different from those of the first embodiment will be described.

It is necessary for the transformer 1 not to form a closed circuit through which an electric current flows around the wound iron core 3, due to its characteristics. Thus, it is impossible to connect all the support frame connecting portions (four corner portions) of the support structures 18 and 19 via welding. Therefore, when connecting the support frame connecting portions of the support frame bodies 18 and 19 by using the bolts 25, an insulation bolt may be used according to a place or the bolt may be used after taking insulation measures.

When the coil expands, the first support structure 18 receives the force in the vertical direction as described above, and as shown in the drawing, the first support structure 18 has the bolts 25 fixing the support frame connecting portions in the vertical direction as shown in the drawings. In addition, the bolts 25 may be preferably inserted in the vertical direction, and thus, a shearing force generated when the coil is short-circuited does not be applied to the bolts 25.

On the other hand, the second support structure 19 receives the force of the horizontal direction when the coil expands as described above, and thus, in the second support structure 19, the support frame connecting portions are held in the horizontal direction (Y-axis direction) by the bolts 25 or the stud bolts 22.

The bolts 25 or the stud bolts 22 may be inserted in the horizontal direction so that a shearing force generated when the coil is short-circuited does not be applied to the corresponding bolts or the stud bolts 22.

That is, a mounting direction of each of the bolts 25 is set to be a direction in which the shearing force is not applied to the bolt 25 when the force of the predetermined direction is applied to each support frame.

According to the above configuration, damage to the bolts 25 at the support frame connecting portions can be prevented. Furthermore, the present embodiment may be combined with the first embodiment.

Third Embodiment

According to the present embodiment, the lower coil insulation member 7 and the iron core support plate 8 are provided at a lower side of the coil 2 to generate a gap 26 of an appropriate size between the iron core support plate and the coil 2.

FIG. 12 is a diagram of the third embodiment of the present invention, and illustrates a positional relation between the coil 2 and the lower coil insulating member 7 and the coil support plate 14 mounted between the coil and the wound iron core 3.

When the coil 2 is short-circuited and expands in the vertical direction, the wound iron core 3 exists in the expanding direction of the vertical direction. Therefore, following the expansion of the coil 2, there is a possibility that the coil 2 or peripheral members thereof may interfere with the wound iron core 3 and break the wound iron core 3.

Here, the gap 26 of an appropriate size (distance) is provided between the lower coil insulating member 7 of the coil 2 or the coil support plate 14, and the lower portion of the wound iron core 3.

The gap 26 is arranged so that the size (distance) of the gap 26 is greater than a size (distance) of the deformation and the wound iron core 3 is not damaged even when the coil 2 is deformed. The size of the gap 26 can be adjusted by installing a height adjustment member on the first support structure 18 or adjusting a thickness of the iron core support plate 8.

The first and second support structures 18 and 19 are arranged at locations equal to or greater than an expansion distance of the coil 2 in the width direction (vertical direction), and not to interfere with each other even when the coil expands.

The size (distance) of the gap 26 is estimated by the same means as the analysis shown in FIG. 9, that is, analyzing the force of the coil 2 for pushing out the peripheral members in the vertical direction.

The lower coil insulation member 7 and the inner lower portion of the wound iron core 3 are arranged to be spaced from each other. That is, by providing a predetermined gap between the lower side of the wound iron core 3 in the coil support plate 14 and the inner lower portion of the wound iron core 3, stretching of the wound iron core 3 upward and downward during the short-circuit of the coil may be prevented.

According to the above configuration, damage to the wound iron core 3 may be prevented even when the coil 2 expands in the vertical direction during the short-circuit of the coil. Furthermore, the present embodiment may be combined with the first embodiment and the second embodiment.

Fourth Embodiment

FIG. 15 is a perspective view showing an example in which a single-phase and three-leg transformer according to the fourth embodiment is supported by first, second, and third support structures.

According to the present embodiment, a third support frame body (also referred to as a third support structure) 28 is provided in addition to the first and second support structures 18 and 19 of the first embodiment, and supports the coil 2 to be interposed in a depth direction (X-axis direction). Accordingly, the coil 2 is supported in three directions, that is, X, Y, and Z-axis directions, by the respective support frame bodies.

The third support structure 28 is located outside the first and second support structures 18 and 19, and for example, is configured to include a pair of outer plates 281 interposing a part of the coil 2 therebetween, and a depth adjustment structure such as a stud bolt 282 connecting the pair of outer plates to each other.

That is, the third support structure 28 includes the pair of plate-shaped members 281 and 281 interposing the coil 2 therebetween in a different direction from that of the connection member, the stud bolt 22 of the second support structure 19, and another adjustment member 282 connecting the plate-shaped members 281 and 281 to each other in order to adjust a distance between the plate-shaped members. The pair of plate-shaped members 281 and 281 are in contact with the coil 2.

Furthermore, the third support structure 28 is movable independently from the first support structure 18 and the second support structure 19, according to the electric current flowing in the coil 2. A bottom surface of the third support structure 28 is in contact with the floor where the transformer is installed.

The third support structure 28 is arranged to interpose front and rear portions of the coil 2 therein to restrain the expansion of the coil 2 in the depth (X-axis) direction.

In summary, although the coil expands when the coil of the coil 2 is short-circuited, the expansion of the coil in the vertical (Z-axis) direction can be restrained by the first support structure 18, the expansion of the coil in the horizontal (Y-axis) direction can be restrained by the second support structure 19, and the expansion of the coil in the depth (X-axis) direction can be restrained by the third support structure 28.

Further, when the third support structure 28 is partially fixed on the upper beam 9 or the lower beam 10, the effect of restraining the deformation of the coil is improved.

The present embodiment may be applied to another transformer having different number of coils and different number of wound iron cores, such as the three-phase and three-leg transformer, the three-phase and five-leg transformer, or the like, as shown in FIGS. 13 and 14.

In a case of the three-phase device, forces in the horizontal direction generated when the coil is short-circuited between a u phase and a v phase, and between the v phase and a w phase are considered to cancel each other. Therefore, the wound iron core protection structure 12 of the second support structure 19 supporting the force in the horizontal direction may be preferably arranged only on one of end-surface of the u phase and the w phase.

In addition, the example in which the wound iron core uses the amorphous foil strip is described in the aforementioned present invention, but wound iron cores including a magnetic material such as a silicon steel sheet, or the like, may be implemented. The same effects may be obtained in the above case.

Further, the present invention is not limited to the above-described embodiments, and various modifications are included. For example, the above-described embodiments have been described in detail in order to explain the present invention in an easy-to-understand manner, and are not necessarily limited to those having all the configurations described. Further, a part of the configuration of one embodiment may be replaced by the configuration of another embodiment, and the configuration of another embodiment may be added to the configuration of one embodiment. Further, it is possible to add, delete, and replace other configurations with respect to apart of the configuration of each embodiment.

REFERENCE SIGNS LIST

1: transformer,
2: coil,
3: iron core,
4: spacer,
5: base,
6: upper coil insulating member,
7: lower coil insulating member,
8: iron core support plate,
9: upper beam,
10: lower beam,
11: pillar,
12: iron core protection frame body (wound iron core protection structure),
13: leg,
14: coil supporter (coil support plate),
15: coil coupling bolt,
16: primary coil,
17: secondary coil,
18: first support frame body (first support structure),
19: second support frame body (second support structure),
20: pillar,
21: pillar,
22: stud bolt,
23: outer plate,
24: gap,
25: bolt,
26: gap,
27: coil insulating member,
28: third support frame body (third support structure).

The invention claimed is:

1. A transformer comprising wound iron cores which have multi-layer band-shape magnetic material, and one or more coils wound to pass through an inner periphery of the wound iron core, the transformer comprising:

a wound iron core holding member that is longer than a width of the wound iron core and supporting an upper inner portion of the wound iron core;

a coil holding member supporting a lower outer portion of the coil;

a first support structure comprising an upper beam arranged on an outer periphery of the wound iron core to support the wound iron core holding, and a lower beam arranged on an outer periphery of the coil to support the coil holding member; and a second support structure comprising a pair of outer plates arranged on an inner portion of the upper beam and connected to a connection member that is longer than a width obtained by adding a diameter of the wound iron core and a diameter of the coil, and a wound iron core protection structure that is longer than a width of the wound iron core, for covering a portion where the outer periphery of the coil and an inner portion of the wound iron core face each other, and being connected to the outer plates, wherein the second support structure is movable independently from the first support structure, according to an electric current flowing in the coil.

2. The transformer according to claim 1, wherein a gap is provided between a lower surface of the coil holding member and a lower inner portion of the wound iron core.

3. The transformer according to claim 1, wherein a gap is provided between an upper surface of the coil and a bottom surface of the wound iron core holding member.

4. The transformer according to claim 1, wherein the connection member comprises an adjustment member for adjusting a length.

5. The transformer according to claim 1, wherein an adjustment member for adjusting a height is installed on a columnar member connecting the upper beam and the lower beam to each other.

6. The transformer according to claim 1, wherein a bottom surface of the second support structure is located at a higher position than a floor where the transformer is installed.

7. The transformer according to claim 1, further comprising a third support structure comprising a pair of plate-shaped members interposing the coil therebetween in a different direction from the connection member, and another adjustment member for connecting the plate-shaped members and adjusting a distance between the plate-shaped members.

8. The transformer according to claim 7, wherein the pair of plate-shaped members are in contact with the coil.

9. The transformer according to claim 7, wherein the third support structure is movable independently from the first support structure and the second support structure, according to the electric current flowing in the coil.

10. The transformer according to claim 7, wherein a bottom surface of the third support structure is in contact with the floor where the transformer is installed.

* * * * *